US007743917B2

(12) United States Patent
Konop et al.

(10) Patent No.: US 7,743,917 B2
(45) **Date of Patent: *Jun. 29, 2010**

(54) PADLOCK DISPLAY PACKAGE

(75) Inventors: Gary Konop, Germantown, WI (US); David Kearns, Hartford, WI (US)

(73) Assignee: Master Lock Company LLC, Oak Creek, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/400,938

(22) Filed: Mar. 10, 2009

(65) Prior Publication Data

US 2009/0173655 A1 Jul. 9, 2009

Related U.S. Application Data

(63) Continuation of application No. 11/635,732, filed on Dec. 7, 2006, now Pat. No. 7,516,843.

(60) Provisional application No. 60/749,324, filed on Dec. 7, 2005.

(51) Int. Cl.
*B65D 73/00* (2006.01)

(52) U.S. Cl. ..... 206/349; 206/461; 206/481; 206/493; 206/495; 206/806

(58) Field of Classification Search ..... 206/349, 206/363, 461, 463–471, 477–483, 493, 495, 206/806; 211/70.6
See application file for complete search history.

(56) References Cited

U.S. PATENT DOCUMENTS

| | | | |
|---|---|---|---|
| 791,912 | A | 6/1905 | Jackson |
| 997,154 | A | 7/1911 | Slaymaker et al. |
| 2,949,185 | A | 8/1960 | Foote et al. |
| 3,236,372 | A | 2/1966 | Foote |
| 3,251,465 | A | 5/1966 | Winkhaus et al. |
| 3,289,830 | A | 12/1966 | Foote |
| 3,497,059 | A | 2/1970 | Watts, Jr. |
| 3,586,163 | A | 6/1971 | Loehrer et al. |
| 4,020,694 | A | 5/1977 | Mayhew |
| 4,328,894 | A | 5/1982 | Edell |
| 4,512,466 | A | 4/1985 | Delang |
| 4,613,038 | A | 9/1986 | Kirk |
| 4,711,352 | A | 12/1987 | Williams et al. |
| 4,948,036 | A | 8/1990 | Loughman |
| 5,259,169 | A | 11/1993 | Appelbaum |
| 5,713,467 | A | 2/1998 | Kao |
| 6,164,463 | A | 12/2000 | Lee |

(Continued)

OTHER PUBLICATIONS

Brinks, Model No. 105-626011, 6 foot Water Resistant 5/8" Key Locking Steel Cable, date unknown, known prior art.

(Continued)

*Primary Examiner*—Bryon P Gehman
(74) *Attorney, Agent, or Firm*—Calfee, Halter & Griswold LLP

(57) ABSTRACT

An exemplary display package for an item having a loop portion includes a card having a front side and a back side, a post extending from the front side of the card, and a hasp extending from the front side of the card to define a slot. The item may be attached to the display package by positioning the loop portion of the item around the post and through the slot.

31 Claims, 4 Drawing Sheets

U.S. PATENT DOCUMENTS

| | | | |
|---|---|---|---|
| 6,241,092 | B1 | 6/2001 | Vasudeva |
| 6,257,536 | B1 | 7/2001 | Manuel |
| 6,378,700 | B1 | 4/2002 | Tong |
| 6,401,924 | B1 | 6/2002 | Fresnel |
| 6,520,324 | B1 | 2/2003 | Matthews et al. |
| 6,679,379 | B1 | 1/2004 | Kao |
| 6,749,060 | B2 | 6/2004 | Ford |
| D494,066 | S | 8/2004 | Liu |
| 6,935,516 | B2 | 8/2005 | Chiang |
| 2003/0024831 | A1 | 2/2003 | Matthews et al. |
| 2003/0034316 | A1 | 2/2003 | Kao |
| 2005/0035013 | A1 | 2/2005 | Bates et al. |

OTHER PUBLICATIONS

Brinks, Model No. 105-38901, 9 foot Weather Resistant 3/8 Steel Cable, date unknown, known prior art.

Kryptonite, 6'×5/8" Locking Cable, date unknown, known prior art.

Kryptonite, 30'×3/8" Braided Steel Cable, date unknown, known prior art.

Master Lock, Model No. 72DPF, 15'×3/8" Heavy Duty Braided Steel Cable, at least as early Dec. 31, 2002, 2 pages.

Master Lock, Model No. 78DPF, 6'×3/8" Braided Steel Cable, at least as early as Dec. 31, 2002, 2 pages.

Master Lock, Model No. 8119DPF, 5' Resettable Combination Cable Lock, at least as early as Dec. 31, 2001, 2 pages.

Master Lock, Model No. 8113DPF, 5' Keyed Cable Lock, at least as early as Dec. 31, 2001, 2 pages.

Master Lock, Model No. 8154DPF, 6' Keyed Cable Lock, at least as early as Dec. 31, 2001, 2 pages.

Master Lock, Model No. 8143DSG, Bike Series, 4 Ft Combination Cable Lock, at least as early as Dec. 31, 2001, 2 pages.

International Search Report and Written Opinion from International Application No. PCT/US2006/46728, mailed Jul. 11, 2008.

PADLOCK DISPLAY PACKAGE

CROSS REFERENCE TO RELATED APPLICATION

This application is a continuation of U.S. patent application Ser. No. 11/635,732, entitled "PADLOCK DISPLAY PACKAGE" and filed on Dec. 7, 2006, now U.S. Pat. No. 7,516,843, which claims the benefit of U.S. Provisional Patent Application Ser. No. 60/749,324, entitled "DISPLAY PACKAGE" and filed Dec. 7, 2005, the entire contents of each are incorporated herein by reference, to the extent that they are not conflicting with the present application.

FIELD OF THE INVENTION

The present invention relates to display packaging and more specifically to a display package for use in displaying and retaining a product.

BACKGROUND OF THE DISCLOSURE

Products are packaged for a variety of retail and commercial purposes, such as for example, for storage, transportation, and display. One type of package known in the art is display card and blister packaging. This type of packaging is used for many products, including, for example, padlocks, such as key operated padlocks and combination padlocks. Conventional packaging typically encapsulates or surrounds the entire product and is sealed closed to prevent removal of the product, for example, to inhibit or deter theft of the product from a retail location. However, this type of packaging, designed to prevent removal of the product from the packaging at the store, may also make it difficult or time consuming for a consumer to remove the product from the packaging after purchase. Also, with most or all of the product encapsulated by this conventional packaging, pre-purchase inspection of the product by a consumer may be inhibited, as a potential buyer may be unable to see or feel many or most of the surfaces of the product.

SUMMARY

As described in the present application, a display package may be configured to securely retain one or more items for display while increasing the areas of the item that may be touched or grasped by a user, such as a potential purchaser, and/or reducing the amount of packaging materials that must be cut, torn, or otherwise separated in order to access the packaged item. In one such embodiment, a display package for an item may include a hasp defining a slot for receiving a loop portion of the item, such as a strap, band, link, or shackle, to secure the item to the package. In an exemplary embodiment, a padlock display package includes a card having a front side and a back side and a hasp extending from the front side of the card to define a slot. The padlock is attachable to the display package by inserting the padlock's shackle through the slot and locking the shackle with the lock body.

As further described in the present application, a display package may further include a post onto which a loop portion may be positioned. In an exemplary embodiment, a display package for an item having a loop portion includes a card having a front side and a back side, a post extending from the front side of the card, and a hasp extending from the front side of the card to define a slot. The item may be attached to the display package by positioning the loop portion of the item around the post and through the slot.

BRIEF DESCRIPTION OF THE DRAWINGS

Further features and advantages of the invention will become apparent from the following detailed description made with reference to the accompanying drawings, wherein.

DETAILED DESCRIPTION

This Detailed Description merely describes exemplary embodiments of the invention and is not intended to limit the scope of the claims in any way. Indeed, the invention as described is broader than and unlimited by the preferred embodiments, and the terms used have their full ordinary meaning.

The present application will primarily describe display packages for use with padlocks. It should be understood that inventive aspects of the present application may also be used with display packages for other items, such as other items having loop portions, including, for example, wrist watches and carabiners.

According to an inventive aspect of the present application, a display package may be configured to securely attach an item having a loop portion to a hasp extending from a display card. As described herein, a "hasp" may include any type of projection at least partially defining a hole, opening, or other such slot, while a "loop portion" may include any segment or portion of material at least partially defining an opening in an item, such as, for example, a strap, band, link, tag, or a shackle. A hasp or loop portion may comprise many different shapes, including, for example, straight, arcuate, or circular segments. For items having a loop portion that separates or opens, such as a padlock or carabiner, the hasp may be integral with the display card. While the display card may be a substantially flat component to which one or more items may be mounted, for example, to hang the items from a rack, the shape, size, thickness, and contours of the display card may be varied to suit the item being packaged, the types of indicia or other information to be included on the display card, and the intended environment for display of the item.

According to another inventive aspect of the present application, a display package may include a display card having a post extending from a front side of the display card. The post may be sized such that a loop portion of an item may be positioned over the post, for example, to secure the item to the display package or to limit movement of the item while attached to the display package. In one embodiment, an outer perimeter of the post may be sized to match or closely fit with an inner perimeter of the loop portion, for example, to further limit movement of the attached item with respect to the display package.

Figure 2:
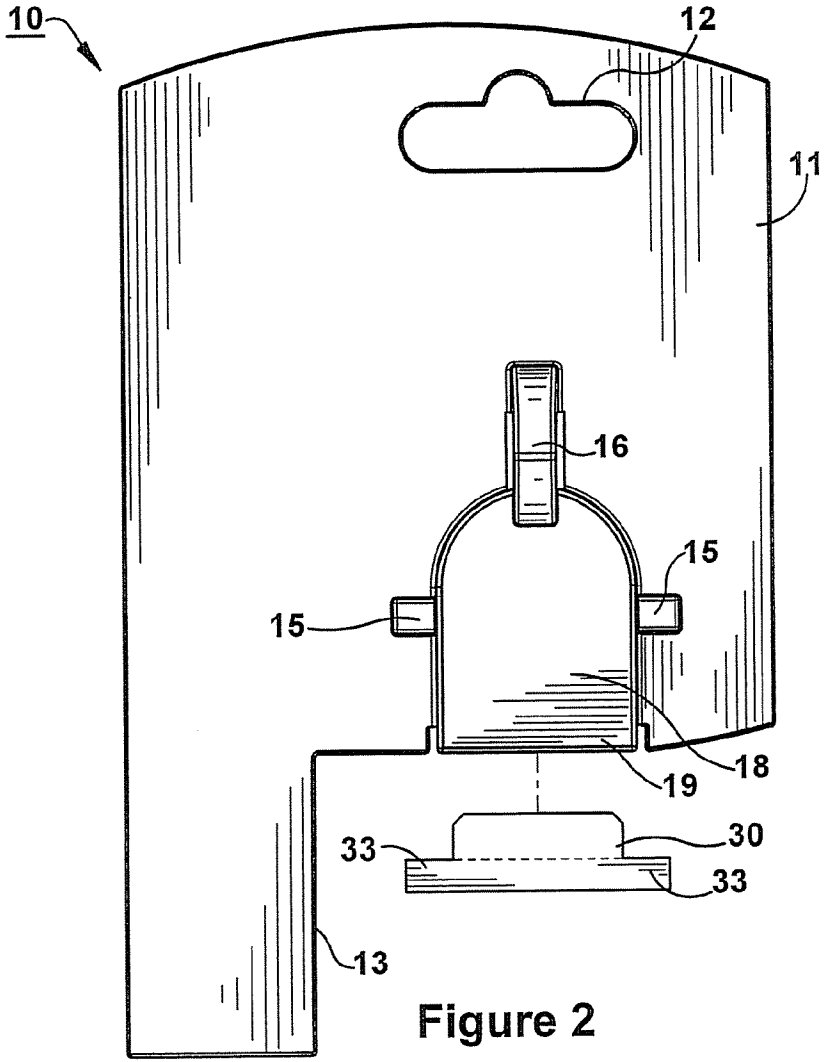
FIG. 2 is a front exploded view of the display package of FIG. 1.
Figure 1:
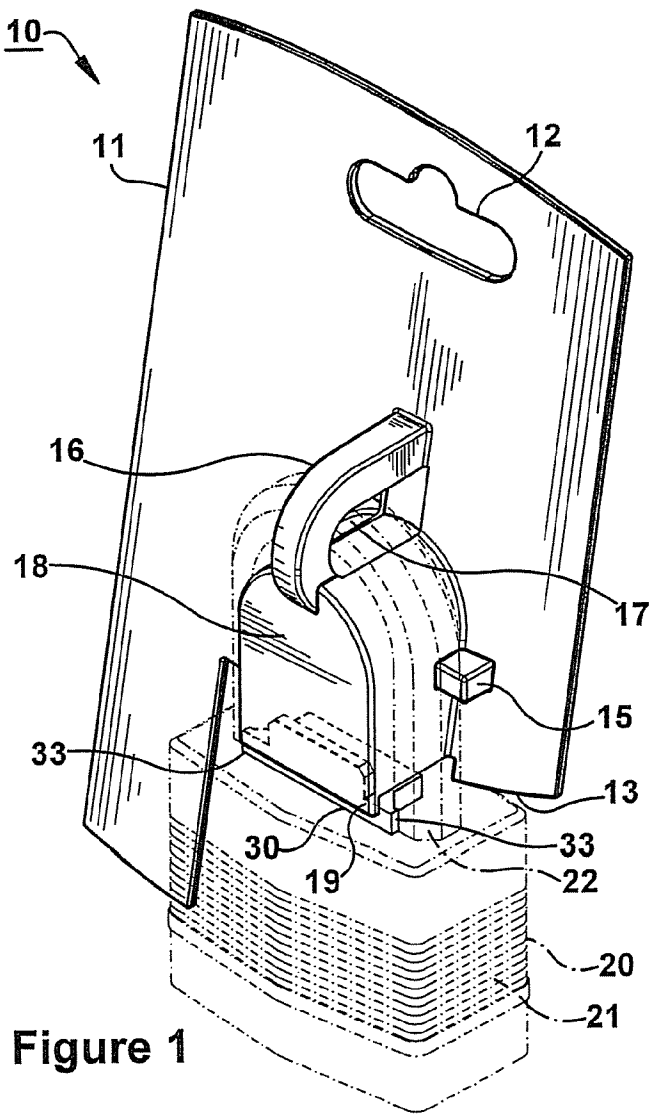
FIG. 1 is a perspective view of a display package, showing a padlock retained on the display package.
Figure 4:
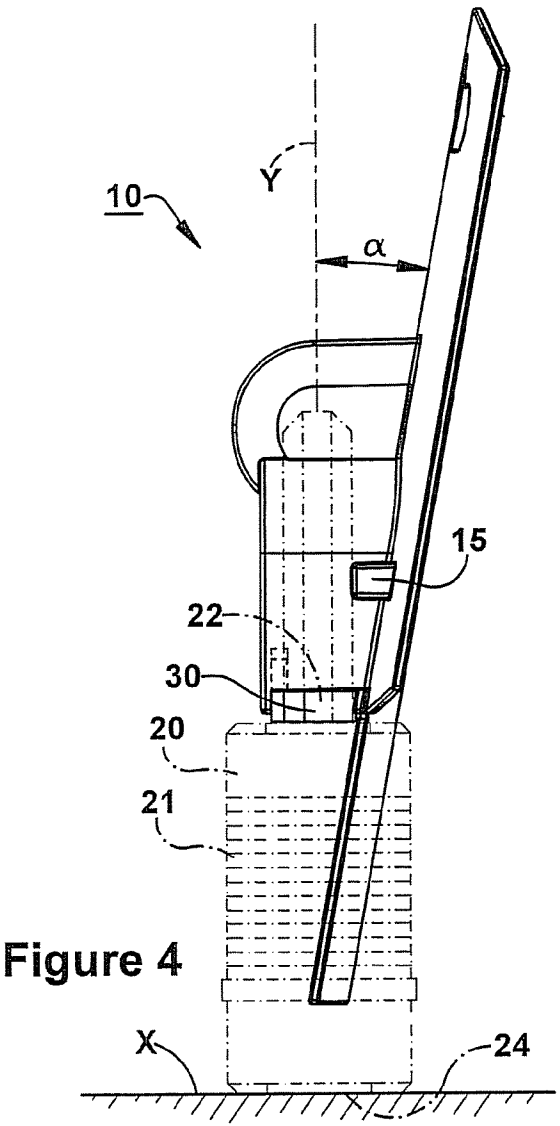
FIG. 4 is a right side view of the display package of FIG. 1, showing a padlock retained on the display package.
Figure 3:
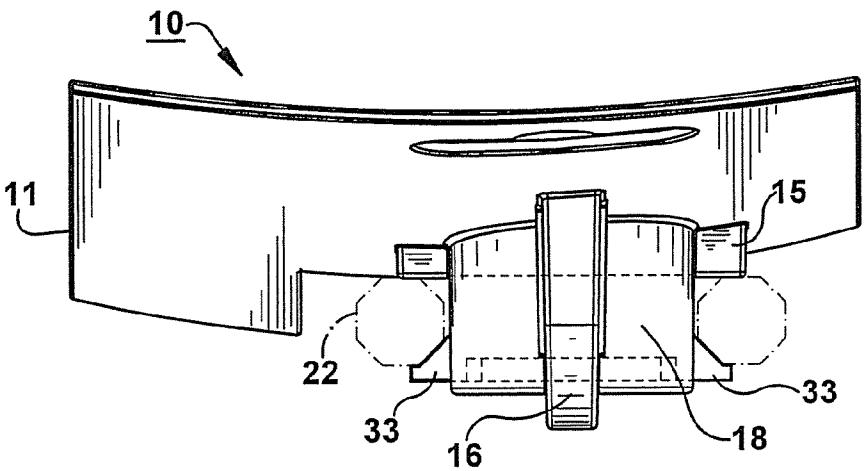
FIG. 3 is a top view of the display package of FIG. 1.

Referring now to the drawings, FIGS. 1-4 illustrate a padlock display package 10 made in accordance with an exemplary embodiment of the present application. The package 10 may be suitable for various display methods at a retail environment, including hanging on a rack or hook and resting on a shelf or platform. The package may be constructed of plastic, corrugate, or any other material of suitable strength. FIGS. 1 and 4 illustrate a padlock 20 in phantom lines as retained on the display package 10.

Still referring to FIG. 1, the package 10 can be formed from several pieces or as a uniform single piece. The exemplary package 10 includes a display card 11, a knob or post 18 extending from a front side of the card 11, and a hasp 16, extending from the front side of the card 11 and to define a slot 17. As illustrated, a portion of the hasp 16 may also extend from the post 18, with the post 18 defining a portion of the slot 17. As shown, the slot 17 may be sized to receive the shackle 22 therethrough, and an outer perimeter of the post 18 may be sized to correspond with or closely match an inner perimeter defined by the shackle 22 and lock body 21 of the padlock 20, which may serve to limit movement of the padlock 20 with respect to the package 10 in a direction substantially parallel to the display card 11. Movement in a direction substantially parallel as used herein may include movement of the padlock relative to the face of the card 11 by an offset angle, such as, for example, the offset angle $\alpha$ as shown in FIG. 4 and described below.

The exemplary display package 10 may be configured to further limit movement of the padlock 20 with respect to the package 10 in a direction substantially perpendicular to the display card 11. For example, the display package 10 may include one or more projections 15 extending from the front side of the card 11 to engage a rear facing portion of the loop portion or shackle 22 of the attached padlock 20, effectively limiting movement of the shackle 22 within the slot 17. As another example, the display package 10 may be configured to engage a front facing surface of the shackle 22 to limit forward rotation of the padlock 20 about the slot 17. While many different configurations may be used to provide engagement with the front surface of the shackle 22, including, for example, prongs extending from the front side of the display card or tabs extending from the sides of the post (not shown), in the illustrated embodiment, a separate retaining member or anchor 30 may be inserted between the post 18 and an upper surface of the lock body 21. The illustrated post 18 includes a downward extending lip 19 that retains the anchor 30 when the padlock 20 is attached to the display package 10. The anchor 30 includes outward extending tabs 33 that engage the front surface of the shackle 22. The engagement between the anchor 30 and the shackle 22 and post 18 limits forward rotation of the padlock 20 about the slot 17. The exemplary anchor 30 remains retained between the post 18 and the padlock 20 until the padlock 20 is removed from the display package 10.

A display package with an attached item may be configured to be displayed either by placement on a shelf or platform or by hanging from a rack or hook. Where the attached item 20 is a free standing item (such as, for example, a padlock with a flat bottom surface), the display card 11 may be sized such that a bottom surface 24 of the item 20 extends below the bottom of the card 11, such that the bottom surface 24 may be directly supported by the shelf or platform X, as shown, for example, in FIG. 4.

The display card may also include a cut-out portion 13 that aligns with a portion of the attached item (for example, the lock body 21 of the illustrated padlock 20) to allow the attached item to extend beyond the back side of the display card 11. This may allow for improved visibility and access to the rear facing surfaces of the attached item 20. Further, in one embodiment, the display package may be configured such that the display card 11 is maintained in an angled (non-parallel) vertical orientation with respect to the item, for example, to aid in visibility of indicia or other markings on the front side of the display card 11 when the display package 10 and item 20 are placed on a shelf below eye level. For example, projections 15 from the display card 11 may hold a middle portion of the shackle 22 further away from the display card 11, while an anchor 30 retains a lower portion of the shackle 22 closer to the display card 11, thereby orienting the display card 11 at an angle $\alpha$ with respect to a vertical center line Y of the attached padlock 20. In one embodiment, the center line Y and the display card 11 form an angle $\alpha$ of approximately 10°. The slot 17 may also be sized to retain the padlock 20 and display card 11 at the desired angle $\alpha$ with respect to each other.

To hang the display package 10 from a rack or hook (not shown), the display card 11 may further define a punch hole or other such opening 12. The hole 12 may be positioned on the card 11 to align with the item 20 to be attached to the display package 10, which may be offset from the center of the card 11, such that the display package 10 with attached item 20 will hang in a straight (non-crooked) orientation.

To attach a padlock to the exemplary display package 10 of FIGS. 1-4, the shackle 22 of the unlocked padlock 20 is inserted through the hasp 16 and positioned around the post 18. The shackle 22 is then locked into engagement with the lock body 21. To remove the padlock from the display package 10, the padlock 20 is unlocked, and the shackle is withdrawn from the hasp 16. In the illustrated embodiment, no additional packaging materials need to be cut, torn, or otherwise separated to remove the padlock 20 for use. However, in other embodiments, additional packaging materials may be used. For example, wrappings may be used to protect the displayed item from the environment.

According to another aspect of the present application, a display package may also be configured to secure one or more accessories associated with or corresponding to the attached item, such as, for example, one or more fasteners, batteries, or padlock keys. In one embodiment, the display card may include a pocket configured to at least partially receive and retain the accessory. For example, the pocket may include a cavity 14*a* extending from the front face of the display card 11, as shown in the exemplary embodiment of FIG. 5. As another example, the pocket may include a slotted or hollow projection 14*b* extending from the front face of the display card 11, as shown in the exemplary embodiment of FIG. 6.

Figure 6:
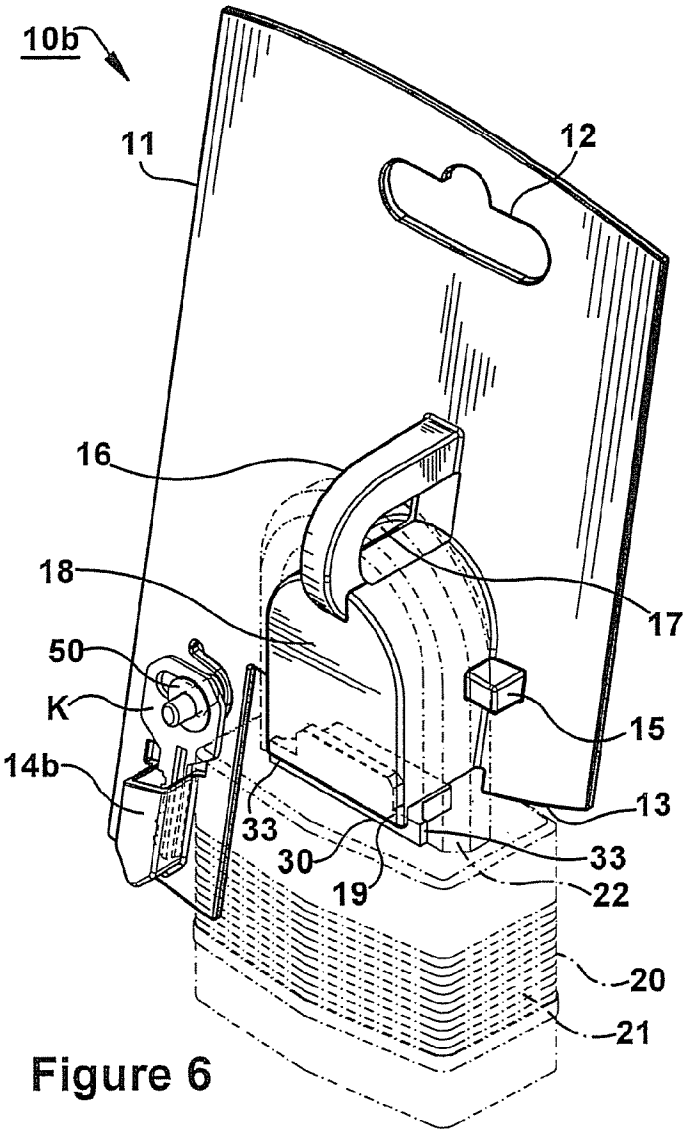
FIG. 6 is a perspective view of another display package having a pocket for storage of at least one accessory.
Figure 5:
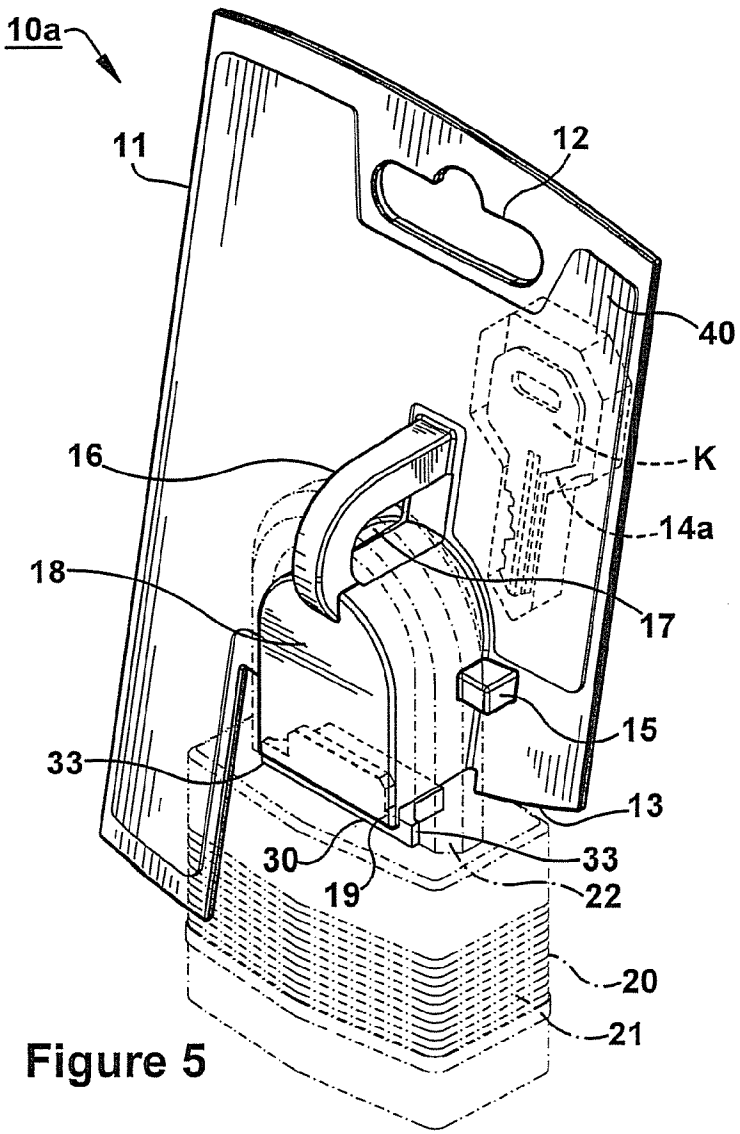
FIG. 5 is a perspective view of a display package having a pocket for storage of at least one accessory.

In the exemplary padlock display package, deterred access to a padlock key may be desirable, as the padlock 20 may be easily removed from the exemplary package 10 by unlocking the padlock 20 and withdrawing the shackle 22 from the hasp 18. Many different configurations may be utilized to deter access to this accessory. For example, the key K may be stored in a cavity 14*a*, as shown in FIG. 5, that is covered by a display label 40 adhered to the front side of the display card 11, such that the label 40 must be peeled or torn from the display card 11 to access the key, which may cause obvious damage to the packaging to identify tampering. In one such examplary embodiment, a portion of the label 40 is transparent, such that the stored key K is visible. As another example, the key K may be attached to the display card by a fastener 50, such as, for example, a post and lock tab arrangement as shown in FIG. 6, requiring tools and/or effort to remove the key for use.

Figure 9:
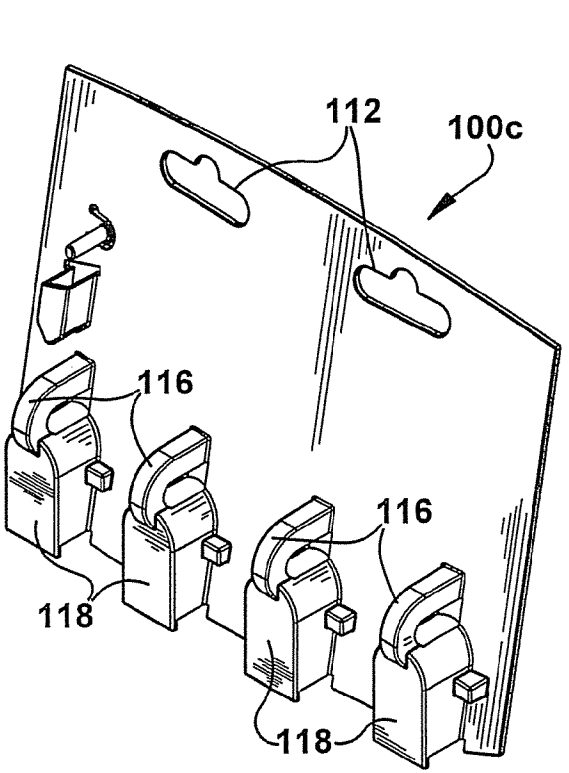
FIG. 9 is a perspective view of a display package configured to retain four attached items.
Figure 8:
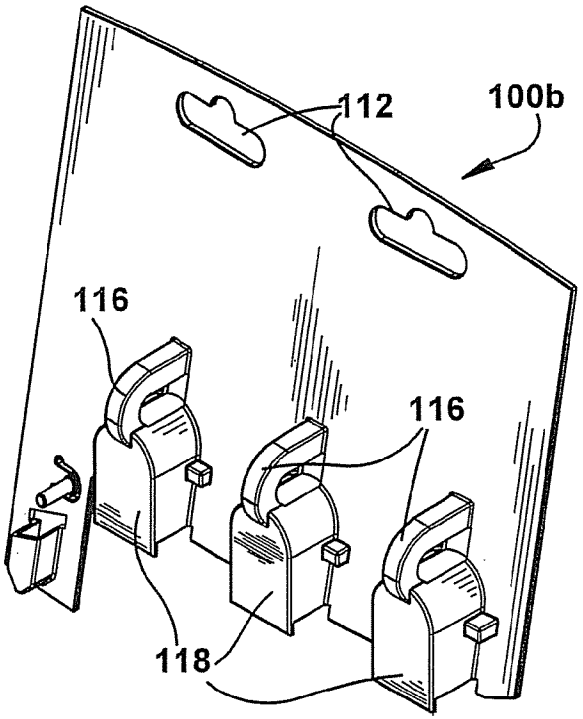
FIG. 8 is a perspective view of a display package configured to retain three attached items.
Figure 7:
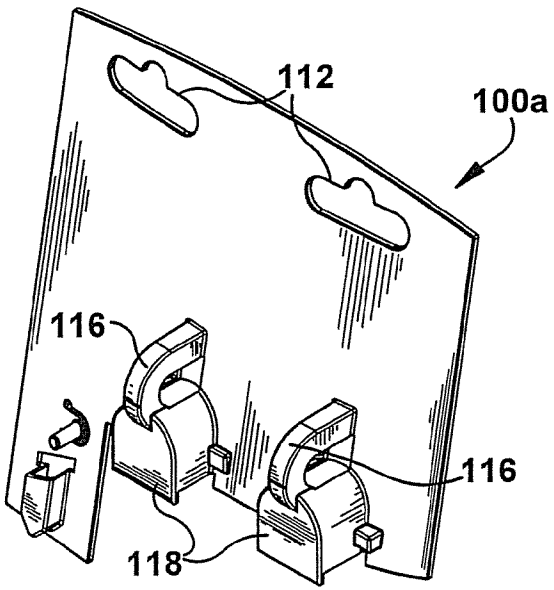
FIG. 7 is a perspective view of a display package configured to retain two attached items.

In other embodiments, a display package may be configured to retain and display multiple items, such as, for example, multiple padlocks. While many different configurations may be used to retain multiple items, in one embodiment, a display package may be provided with multiple hasps, wherein each hasp is configured to retain one item. For example, FIGS. 7, 8, and 9 illustrate padlock display packages 100*a*, 100*b*, 100*c* configured to accommodate two, three, and four padlocks, respectively. The features of each display package 100*a*, 100*b*, 100*c*, such as, for example, the hasps 116 and posts 118, may, but need not, be consistent with the features of the display packages of FIGS. 1-6. In another embodiment (not shown), a display package may be configured to retain multiple items by including an elongated hasp through which loop portions of multiple items may be inserted, and an elongated post, over which loop portions of multiple items may be positioned. As shown in FIGS. 7-9, a larger display package 100*a*, 100*b*, 100*c* may include multiple punch holes 112 to provide additional support for the display packages when hanging.

While various inventive aspects, concepts and features of the inventions may be described and illustrated herein as embodied in combination in the exemplary embodiments, these various aspects, concepts and features may be used in many alternative embodiments, either individually or in various combinations and sub-combinations thereof. Unless expressly excluded herein all such combinations and sub-combinations are intended to be within the scope of the present inventions. Still further, while various alternative embodiments as to the various aspects, concepts and features of the inventions—such as alternative materials, structures, configurations, methods, circuits, devices and components, software, hardware, control logic, alternatives as to form, fit and function, and so on—may be described herein, such descriptions are not intended to be a complete or exhaustive list of available alternative embodiments, whether presently known or later developed. Those skilled in the art may readily adopt one or more of the inventive aspects, concepts or features into additional embodiments and uses within the scope of the present inventions even if such embodiments are not expressly disclosed herein. Additionally, even though some features, concepts or aspects of the inventions may be described herein as being a preferred arrangement or method, such description is not intended to suggest that such feature is required or necessary unless expressly so stated. Still further, exemplary or representative values and ranges may be included to assist in understanding the present disclosure; however, such values and ranges are not to be construed in a limiting sense and are intended to be critical values or ranges only if so expressly stated. Moreover, while various aspects, features and concepts may be expressly identified herein as being inventive or forming part of an invention, such identification is not intended to be exclusive, but rather there may be inventive aspects, concepts and features that are fully described herein without being expressly identified as such or as part of a specific invention, the inventions instead being set forth in the appended claims. Descriptions of exemplary methods or processes are not limited to inclusion of all steps as being required in all cases, nor is the order that the steps are presented to be construed as required or necessary unless expressly so stated.

We claim:

1. In combination, a padlock and a padlock display package, the padlock having a shackle lockable with a lock body, the padlock display package comprising:

a card having a front side and a back side;

a hasp extending from the front side of the card to define at least a portion of a slot, wherein the padlock is secured to the display package when the locked shackle is positioned through the slot;

at least a first padlock retaining surface extending outward from the front side of the card and spaced apart from the hasp, the first padlock retaining surface being configured to limit clockwise and counterclockwise swinging movement of the padlock with respect to the package in a direction substantially parallel to the card; and a bottom end of the lock body extending beyond a bottom end of the card.

2. The combination of claim 1, wherein the bottom end of the lock body may be directly supported by a shelf when the padlock is installed on the display package.

3. The combination of claim 1, wherein when the display package is hung from a support, the bottom end of the lock body extends beyond the bottom end of the card.

4. The combination of claim 1, wherein the card is configured to allow the lock body to extend rearward of a frontmost surface of the card.

5. The combination of claim 1, further comprising a key for unlocking the padlock, wherein the card further comprises a pocket for receiving at least a portion of the key.

6. The combination of claim 5, wherein the pocket comprises a cavity in extending from the front side of the card for receiving the entire key, and a fastener securing the key within the cavity.

7. The combination of claim 5, wherein the pocket is larger than a perimeter of the entire key.

8. The combination of claim 1, wherein the first padlock retaining surface limits clockwise and counterclockwise swinging movement of the padlock by engaging the shackle.

9. The combination of claim 1, further comprising a second padlock retaining surface spaced apart from the hasp and separated from the first padlock retaining surface, the second padlock retaining surface being configured to engage the padlock to limit movement of the padlock in a direction substantially perpendicular to the front side of the card.

10. The combination of claim 9, wherein the second padlock retaining surface is configured to engage a front surface of the shackle.

11. The combination of claim 9, wherein the second padlock retaining surface is disposed on an anchor installed between the shackle and the display package.

12. The combination of claim 1, wherein the display package permits movement of the padlock in a direction substantially perpendicular to the front side of the card.

13. The combination of claim 1, wherein the padlock is removeable from the display package by unlocking the shackle from the lock body and withdrawing the shackle from the slot.

14. In combination, a padlock and a padlock display package, the padlock having a shackle lockable with a lock body, the padlock display package comprising:

a card having a front side and a back side;

a hasp extending from the front side of the card to define at least a portion of a slot, wherein the padlock is secured to the display package when the locked shackle is positioned through the slot;

at least a first padlock retaining surface extending outward from the front side of the card and spaced apart from the hasp, the padlock retaining surface being configured to limit clockwise and counterclockwise swinging movement of the padlock with respect to the package in a direction substantially parallel to the card;

a cavity extending from the front side of the card for receiving an entirety of a key therein; and a fastener for securing the key within the cavity.

15. The combination of claim 14, wherein a bottom end of the lock body is uncovered by the display package.

16. The combination of claim 14, wherein a bottom end of the lock body extends beyond a bottom end of the card.

17. The combination of claim 16, wherein the bottom end of the lock body may be directly supported by a shelf when the padlock is installed on the display package.

18. The combination of claim 14, wherein the display package permits movement of the padlock in a direction substantially perpendicular to the front side of the card.

19. The combination of claim 14, further comprising a second padlock retaining surface spaced apart from the hasp and separated from the first padlock retaining surface, the second padlock retaining surface being configured to engage the padlock to limit movement of the padlock in a direction substantially perpendicular to the front side of the card.

20. The combination of claim 19, wherein the second padlock retaining surface is configured to engage the shackle.

21. The combination of claim 14, wherein the card is configured to allow the lock body to extend rearward of a frontmost surface of the card.

22. In combination, a padlock and a padlock display package, the padlock having a shackle lockable with a lock body, the padlock display package comprising:

a card having a front side and a back side;

a hasp extending from the front side of the card to define at least a portion of a slot, wherein the padlock is secured to the display package when the locked shackle is positioned through the slot;

a first padlock retaining surface extending outward from the front side of the card and spaced apart from the hasp, the first padlock retaining surface being configured to limit clockwise and counterclockwise swinging movement of the padlock with respect to the package in a direction substantially parallel to the card; and a second padlock retaining surface spaced apart from the hasp and separated from the first padlock retaining surface, the second padlock retaining surface being configured to engage a frontmost surface of the padlock to limit movement of the padlock in a direction substantially perpendicular to the front side of the card.

23. The combination of claim 22, wherein the second padlock retaining surface is configured to engage the shackle.

24. The combination of claim 22, wherein the second padlock retaining surface is disposed on an anchor installed between the shackle and the display package.

25. The combination of claim 22, further comprising a cavity extending from the front side of the card for receiving a key therein, and a fastener for securing the key within the cavity.

26. In combination, a padlock and a padlock display package, the padlock having a shackle lockable with a lock body, the padlock display package comprising:

a card having a front side and a back side;

a hasp extending from the front side of the card to define at least a portion of a slot, wherein the padlock is secured to the display package when the locked shackle is positioned through the slot;

a padlock retaining surface extending outward from the front side of the card and spaced apart from the hasp, the padlock retaining surface being configured to limit clockwise and counterclockwise swinging movement of the padlock with respect to the package in a direction substantially parallel to the card;

a cavity extending from the front side of the card for receiving a key therein; and a fastener for securing the key within the cavity;

wherein the display package permits movement of the padlock in a direction substantially perpendicular to the front side of the card;

further wherein the card is configured to allow the lock body to extend rearward of a frontmost surface of the card; and further wherein a bottom end of the lock body extends beyond a bottom end of the card.

27. The combination of claim 26, wherein the bottom end of the lock body may be directly supported by a shelf when the padlock is installed on the display package.

28. The combination of claim 26, wherein the padlock is removeable from the display package by unlocking the shackle from the lock body and withdrawing the shackle from the slot.

29. The combination of claim 26, wherein an entirety of the key is received within the cavity.

30. The combination of claim 26, wherein the cavity is larger than a perimeter of the entire key.

31. In combination, a padlock and a padlock display package, the padlock having a shackle lockable with a lock body, the padlock display package comprising:

a card having a front side and a back side;

a hasp extending from the front side of the card to define at least a portion of a slot, wherein the padlock is secured to the display package when the locked shackle is positioned through the slot;

a cavity extending from the front side of the card for receiving a key therein; and a fastener for securing the key within the cavity; and a bottom end of the lock body extending beyond a bottom end of the card.

* * * * *

UNITED STATES PATENT AND TRADEMARK OFFICE

CERTIFICATE OF CORRECTION

PATENT NO. : 7,743,917 B2
APPLICATION NO. : 12/400938
DATED : June 29, 2010
INVENTOR(S) : Gary Konop et al.

It is certified that error appears in the above-identified patent and that said Letters Patent is hereby corrected as shown below:

Claim 6, Column 6, line 26, after "cavity" delete the word "in".

Signed and Sealed this

Twenty-eighth Day of September, 2010

David J. Kappos

David J. Kappos
*Director of the United States Patent and Trademark Office*